US008640299B2

(12) United States Patent
Tetteh

(10) Patent No.: US 8,640,299 B2
(45) Date of Patent: Feb. 4, 2014

(54) INDOOR/OUTDOOR CLEANING SYSTEM

(75) Inventor: Albert Tetteh, Frederick, MD (US)

(73) Assignee: Albert E. Tetteh, Frederick, MD (US)

( * ) Notice: Subject to any disclaimer, the term of this patent is extended or adjusted under 35 U.S.C. 154(b) by 727 days.

(21) Appl. No.: 12/656,748

(22) Filed: Feb. 16, 2010

(65) Prior Publication Data

US 2010/0150640 A1 Jun. 17, 2010

Related U.S. Application Data

(63) Continuation-in-part of application No. 11/288,335, filed on Nov. 29, 2005, now abandoned.

(60) Provisional application No. 60/631,211, filed on Nov. 29, 2004.

(51) Int. Cl.
*A47L 11/30* (2006.01)

(52) U.S. Cl.
USPC ..... 15/322

(58) Field of Classification Search
USPC ..... 15/320, 321, 322, 353, 354
See application file for complete search history.

(56) References Cited

U.S. PATENT DOCUMENTS

| | | | | |
|---|---|---|---|---|
| 4,542,556 | A * | 9/1985 | Hepple | 15/321 |
| 7,140,060 | B1 * | 11/2006 | Walker | 15/98 |
| 7,313,840 | B2 * | 1/2008 | Watkins | 15/103 |
| 2011/0165825 | A1 * | 7/2011 | Kimura et al. | 451/64 |

* cited by examiner

*Primary Examiner* — Robert Scruggs
(74) *Attorney, Agent, or Firm* — Imad Soubra

(57) ABSTRACT

An indoor/outdoor cleaning system includes a portable pressurized housing for containing cleaning fluids (water, chemicals, and mixtures thereof). Multiple hoses connect the interior of the housing with a cleaning wand. The wand includes a handle, a hollow trunk portion and a cleaning head. The multiple hoses have outlets adjacent the cleaning head for feeding water, cleaning chemicals, or surface treating fluids thereto. The outlets open adjacent a cleaning pad, which pad, which pad is attached to the cleaning head via a mechanism that allows the pad to move either in a linear or sinusoidal (rocking) motion or the combination of both motions thereof. A variety of cleaning pad accessories (brush, sponge, sanding pad, buffing pad, etc.) can be optionally attached to the cleaning pad based on the type of surface to be cleaned or treated. A suction conduit, disposed in the cleaning head, functions to draw used fluids away from the surface for safe disposal thereof.

6 Claims, 7 Drawing Sheets

INDOOR/OUTDOOR CLEANING SYSTEM

CROSS-REFERENCE TO RELATED APPLICATIONS

This application claims the benefit of U.S. Provisional Patent Application Ser. No. 60/631,211 filed Nov. 29, 2004. This application is a Continuation-in-Part application Ser. No. 11/288,335 of US Non-Provisional Patent Application Ser. No. 2006/0112513 A1 filed Nov. 29, 2005 now abandoned.

BACKGROUND OF THE INVENTION

1. Field of the Invention

The present invention generally relates to cleaning systems. More specifically, the present invention is drawn to a cleaning or surface-treating system in which pressurized water, water/chemical mixtures or surface treating fluids are supplied to a sonic vibrating cleaning pad. The cleaning pad can travel in both the linear and oscillating motions.

2. Description of the Related Art

Homeowners and small commercial establishments constantly search for affordable, portable, efficient cleaning devices that are also versatile. Surfaces around the home or office such as floors, decks, walls, driveways, carpets, upholstery, etc. require cleaning or treating on a periodic basis. More often than not, the home or business owner will attempt to clean or treat these surfaces instead of hiring professional cleaners. The most popular cleaning devices, as shown in the related art, rely on pressurized spray nozzles to accomplish the above noted functions. While somewhat effective, the pressurized nozzle units sill leave a lot to be desired, especially when used to clean heavy, layered grime and dirt from surfaces. The art would certainly welcome a cleaning system that could handle a variety of cleaning situations in an effective and efficient manner and yet have the simplicity to be operated by everyone.

None of the inventions and patents identified in the previous IDS, taken either singly or in combination, is seen to describe the cleaning system as will subsequently be described and claimed in the instant invention.

SUMMARY OF THE INVENTION

The indoor/outdoor cleaning system of the present invention comprises a portable, pressurized housing for containing cleaning or treating fluids (water, chemicals and mixtures thereof). The housing is pressurized for reasons that will be explained below. Multiple hoses connect the interior of the housing with a cleaning wand. The wand includes a handle, a hollow trunk portion and a cleaning head. The multiple hoses have outlets in the cleaning head for feeding water and cleaning chemicals thereto. The outlets open adjacent a cleaning pad, which pad is attached to the cleaning head via a mechanism that allows the pad to vibrate at sonic frequency. An accessory (brush, sponge, sanding pad, buffing pad, etc.) is removably attached to the pad and will be selected based on the type of surface to be cleaned or treated. A suction conduit, disposed in the cleaning head, functions to draw used fluids away from the surface for safe disposal thereof.

Accordingly, the invention presents a cleaning system, which system is capable of effectively cleaning and/or treating almost any surface. The system is relatively compact and portable, which permits the system to be utilized by homeowners and small business establishments. Utilization of sonic vibration technology permits the cleaning or treating fluids to be applied to the desired surface area with minimum spillage and waste. The cleaning pad unit of the device can have both a linear motion and an oscillatory motion. The linear motion is both a back and forth motion where an oscillating motion can be activated as well in order to clean between spaces of the tiles, woods or any other material where dirt can easily hide. The back and forth motion of the device can be adjusted by the operator by making the accessory travel in greater distance between each stroke or shorter distance to focus on a particular area. Also, the oscillating motion of the device can provide for a rocking motion or seesaw motion to scrub or remove dirt where gaps exist between materials.

The invention provides for improved elements and arrangement thereof for the purposes described which are inexpensive, dependable and fully effective in accomplishing their intended purposes.

A clear understanding of the present invention will become readily apparent upon further review of the following specification and drawings.

DETAILED DESCRIPTION OF THE PREFERRED EMBODIMENTS

Figure 1:
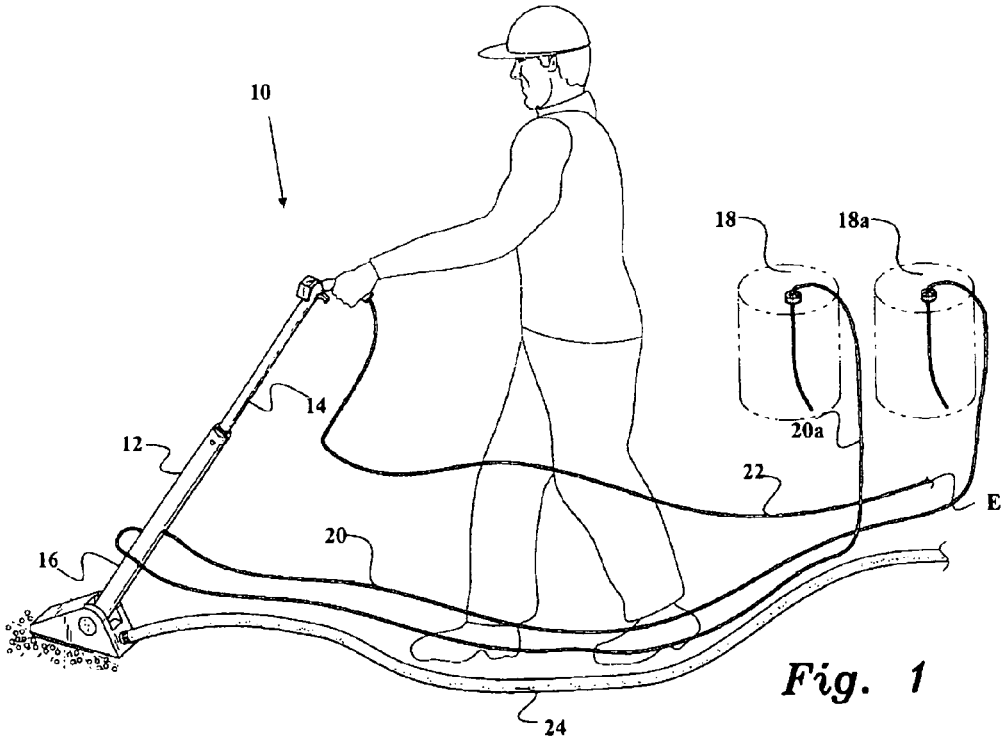
FIG. 1 is an environmental, perspective view of an indoor/outdoor cleaning system according to the present invention.
Figure 2:
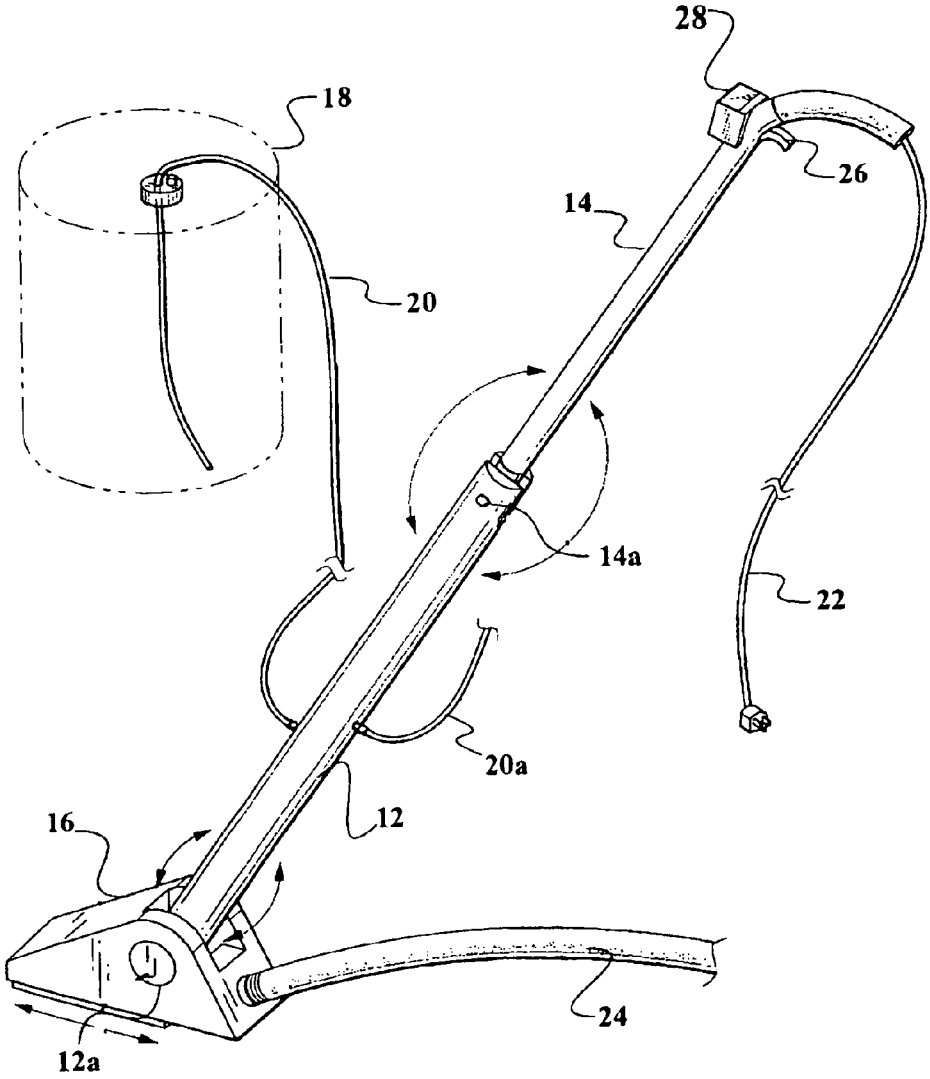
FIG. 2 is a perspective view of a cleaning wand of an indoor/outdoor cleaning system according to the present invention.

Attention is first directed to FIGS. 1 and 2 wherein the cleaning system of the present invention is generally indicated at 10. System 10 includes a cleaning wand 12 having a handle 14 attached at an upper end and a cleaning head 16 attached at a lower end. Pressurized housings 18, 18*a* respectively contain fluids to be supplied to cleaning head 16 via hoses 20 and 20*a*. Power cord 22 extends from handle 14 for connection to a source of electrical power E. A suction hose 24 is in fluid communication with cleaning head 16. As best seen in FIG. 2, handle 14 is pivotally attached to wand 12 at 14*a*. Wand 12 is pivotally attached to cleaning head 16 at 12*a*. A multi-function operating switch 26 and a LCD monitor 28 (both of whose functions are explained below) are mounted on handle 14.

Figure 3:
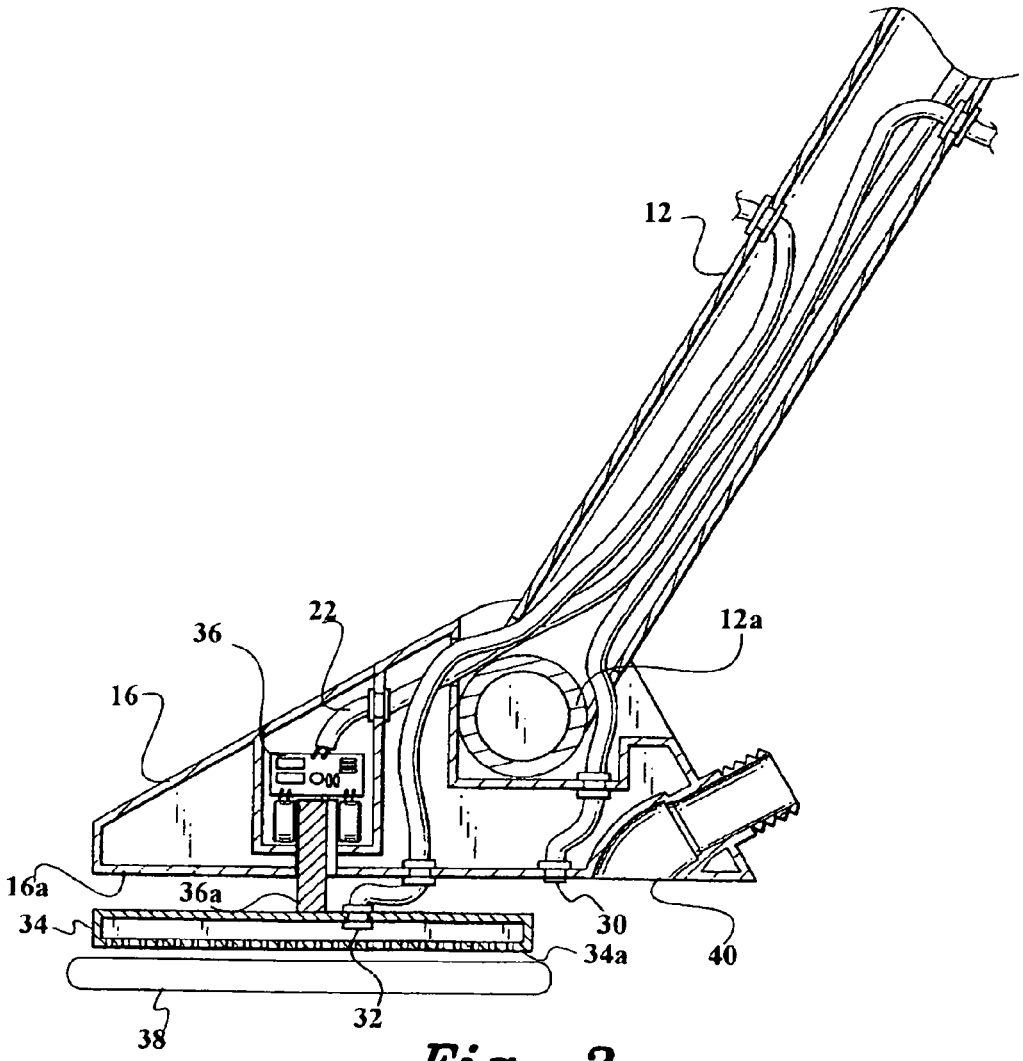
FIG. 3 is a partial view showing a cleaning head of an indoor/outdoor cleaning system according to the present invention.
Figure 4:
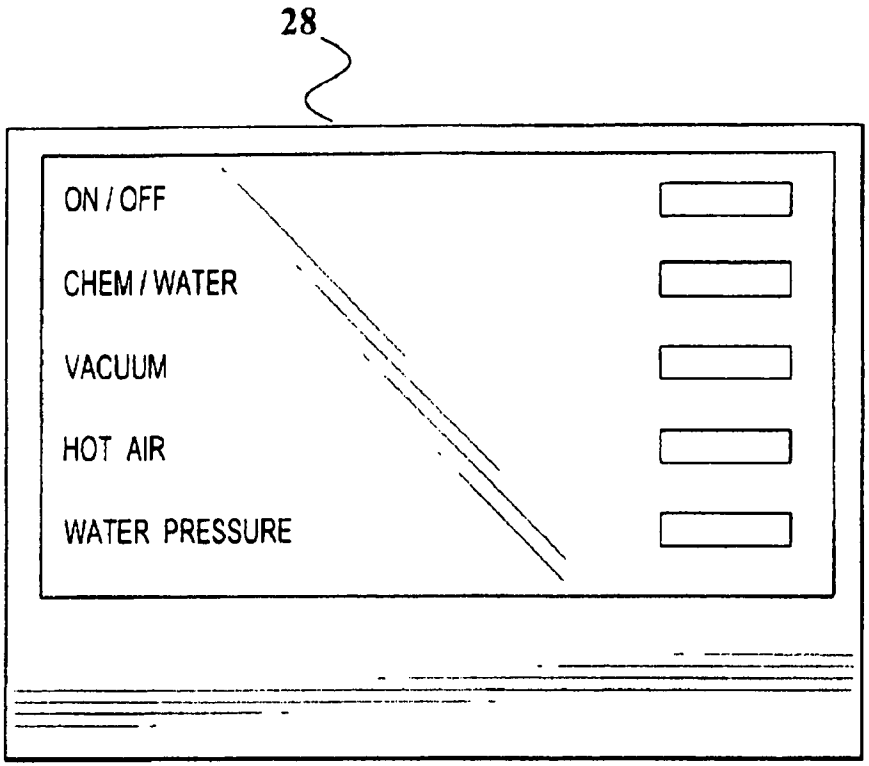
FIG. 4 is a plan view of an LCD screen of an indoor/outdoor cleaning system according to the present invention.

As best illustrated in FIG. 3, wand 12 and head 16 have hollow interiors for receiving hoses 20, 20*a* and power cord 22. Hose 20*a* has an outlet 30 at base 16*a* of cleaning head 16. A cleaning pad unit 34 is disposed adjacent base 16*a* and is spaced therefrom. A cleaning pad unit 34 has a hollow interior and a perforated base 34*a*. Hose 20 has an outlet 32 that opens into the interior of the cleaning pad unit 34. An electronically powered motor 36 is positioned in head 16 and is connected to power cord 22. Motor 36 functions to produce vibratory motion in shaft 36*a*, which shaft 36*a* is connected to cleaning pad unit 34. The motor 36 is designed to produce vibratory motion in the range of 40,000-15,000 strokes per minute. A replacable accessory 38 is removably mounted on the cleaning pad unit 34. As noted above, accessory 38 will be selected based on the type of surface that is to be cleaned or treated. The removable accessory 38 can be a brush head, mop head, scrubber, or any type of good used for cleaning surfaces. A suction port 40 is provided to remove the used fluids from the treated surfaces. Suction port 40 is connected to suction hose 24. LCD readout device 28 (FIG. 4) is mounted on the handle and is programmed to monitor selected functions. The functions shown are merely examples of the many functions that may be monitored.

Referring to FIG. 3, the cleaning pad unit 34 travels in a linear motion when the cleaning device is activated for vibratory motion. The linear motion is a back and forth motion 12*a* as shown in FIG. 2. A stroke is defined by the distance the cleaning pad unit 34 can travel within the wand 12. One stroke can be up to 6 inches from the back end to the front end of the base 16*a*. The user can adjust a stroke where the cleaning pad unit 34 can travel less than 6 inches or more than 6 inches. The stroke can be adjusted to be less than a ¼ of an inch. The user can use a user interface to adjust the stroke to travel a desired distance to cover a certain surface area, which a user interface is not shown in the embodiment, but can be employed to change the distance at which the cleaning pad unit 34 can travel for each stroke. The user interface is connected to a control processing unit (not shown) which is then connected to the cleaning pad unit 34. The user can desire to maintain the stroking distance to be the same throughout the entire cleaning process or he can change the stroking distance.

The importance behind changing the stroking distance to have the replaceable accessory 38 to concentrate on the surface area at which the user desired to be scrubbed, wiped, or cleaned. If the stroking distance of the cleaning pad unit 34 covers a small area such as ¼ of an inch, then the replaceable accessory 38 may focus on a particular area to remove a stain or hardened dirt. If the stroking distance of the cleaning pad unit 34 is greater than 6 inches, then cleaning pad unit will clean more of the surface area with each stroke and it would not be as focus covering a greater area with each stroke.

Figure 5:
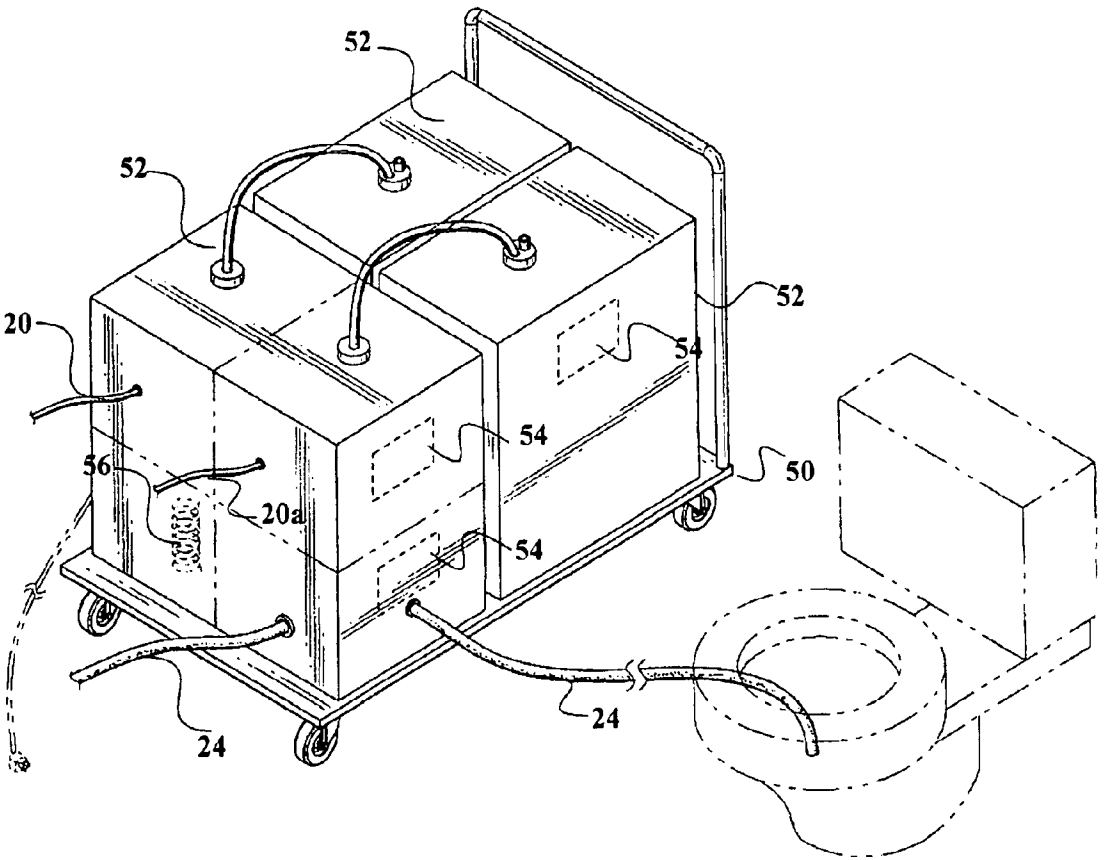
FIG. 5 is a perspective view of a cleaning caddy of an indoor/outdoor cleaning system according to the present invention.

To facilitate the cleaning or treating operation and to enhance portability, a caddy 50 (FIG. 5) is provided to transport housings 52. Housings 52 are adapted to contain all fluids that are utilized in a cleaning or treating process. The housings are provided with pumps 54 for pressurizing the fluids and supplying said fluids to the wand via hoses 20, 20*a*. A pump also induces suction in suction hose 24 for evacuating the used fluids to the wand via hoses 20, 20*a*. A pump also induces suction in suction hose 24 for evacuating the used fluids and disposing of the same. A heating coil 56 is utilized to hear the cleaning or treating fluids if desired.

Figure 6:
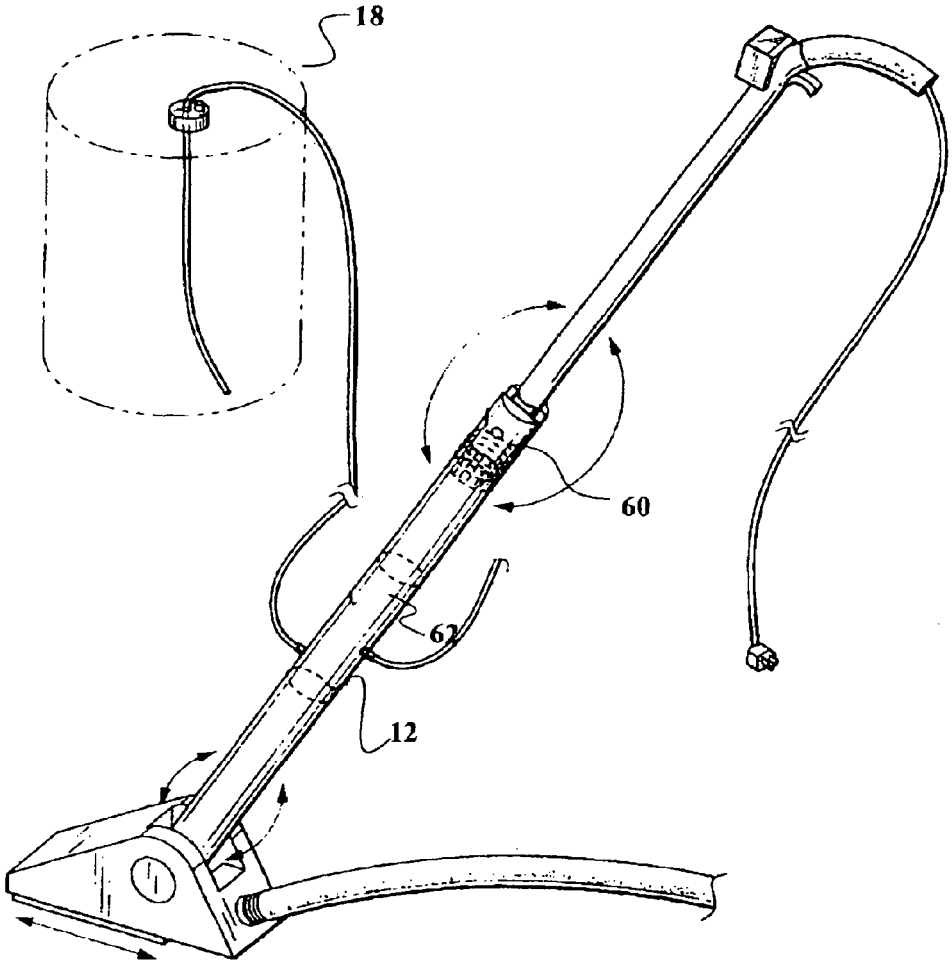
FIG. 6 is a perspective view of a second embodiment of a cleaning was of an indoor/outdoor cleaning system according to the present invention.

In a second embodiment, as illustrated in FIG. 6, the wand 12 is self-contained in that a rechargeable battery 60 and pump 62 (both shown in phantom lines) are encased in wand 12. The battery provides power to motor 36 while the pump extracts fluids from housing 18. It should also be noted that housing 18 can take on the form of a canister mounted to the exterior of the wand.

In use, manipulation of multi-function switch 26 will activate a pump(s) for supplying fluids (for example cleaning fluid and water) through hoses 18, 18*a*. Switch 26 also functions to operate motor 36 to vibrate the accessory 38. Cleaning fluid and water will exit the cleaning head whereby the cleaning pad unit 34 employs vibratory motion to clean the desired surface. A suction pump can be activated to withdraw the used fluids away form the surface for safe disposal.

Figure 7:
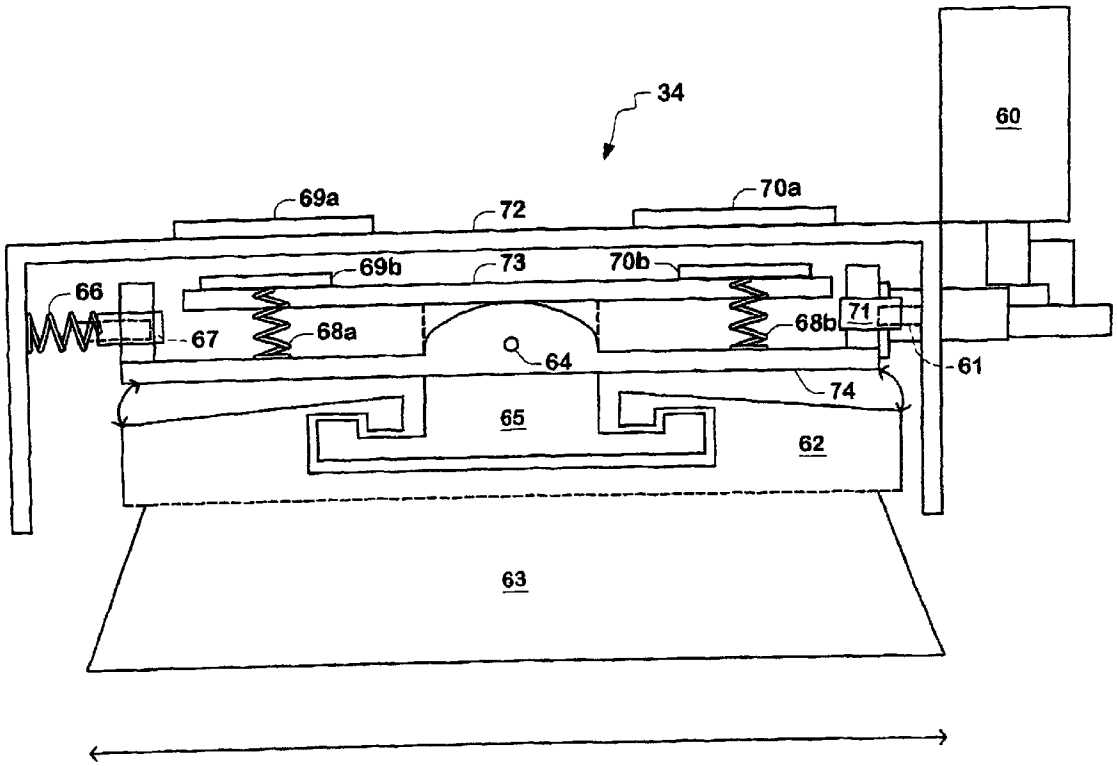
FIG. 7 is a partial side view showing an alternative embodiment of the cleaning pad unit of an indoor/outdoor cleaning system according to the present invention.

FIG. 7 renders an alternative embodiment of the cleaning pad unit 34 having electromagnets which provides the pad or removable accessory 63 with oscillatory motion. The cleaning pad units include a motor 60, shaft 61, frame 72. There can be one motor in the center of the frame 72, or there can be two motors 60 on each end of the frame 71. There can be more motors 60 in order to provide the cleaning pad unit 34 with more power to scrub the dirt from surfaces.

Furthermore, FIG. 7 shows the cleaning pad unit 34 having a pad (or removable accessory) 63, pivot point 64, coupler 65. The motor 60 is connected to the shaft 61 which the shaft 61 is attached to a guide 71 and linear member 74. Once again, if there a plurality of motors and shafts, then there will be a plurality of guides 71. There is a second guide 67 on the linear member 74 connected to a resistance member 66 to prevent the structure moving in the linear motion from colliding with the frame 72. On the frame 72, there are about two electromagnets 69*a*, 70*a* connected on each end of the frame 72, and two metal plates 69*b*, 70*b* are connected on the oscillating member 73. The structural set up for FIG. 7 permits a rocking motion to take place for the oscillating member 73. This rocking motion is like a seesaw motion or oscillating motion for the oscillation member 73 which is connected to the coupler 65 and that oscillating motion is translated onto the pad or removable accessory 63. The electromagnets 69*a*, 70*a* are facing the metal plates 69*b*, 70*b*, respectively. Elastic members 68*a*, 68*b* are sandwiched and connected between the oscillating member 73 and linear member 74, so that way both members would not collide with each other preventing damage between the oscillating member 73 and linear member 74.

Through the user interface, a person can activate the electromagnets 69*a*, 70*a* where both of them may have current running through at the same time to produce an up and down motion. When the electromagnets 69*a*, 70*a* are activated current is flowing through it to produce a magnetic field forcing the metal plates 69*b*, 70*b* to move towards the electromagnets 69*a*, 70*a* where the metals 69*b*, 70*b* would be attracted to the electromagnets 69*a*, 70*a*. By producing an oscillating motion or seesaw motion, a person can activate one electromagnet 69*a* while the other electromagnet 70*a* is deactivated to bring one end of the oscillating member 74 down and the other end up. And then, the electromagnet 69*a* is deactivated while the other electromagnet 70*a* is activated producing an oscillatory motion like a seesaw or rocking motion. In other words, oscillating member 74 pivots up on one end and then down on the other end. This type of oscillating motion happens several times a second. The user can also activate the motor(s) 60 to produce the linear motion while the oscillating motion occurs, so the invention can produce both stroking (linear) and oscillating (seesaw, rocking or pivots) motion at the same time through the coupler 65 that both motions can be translated to the pad or removable accessory 63. The purpose for these types of motion so that the pad or removable accessory 63 would be able to contact spaces between the tiles (kitchen or bathroom) or lumbers (deck) removing the dirt between crevices.

The cleaning system has two main parts. The first is a transfer unit 52. The transfer unit 52 is a caddy 50 for holding removable and replaceable pumps 54 and vacuum motors (not shown). The cartridge style pumps 54 come in different varieties, such as 1. water (cold, hot, mist, high and low pressure or steam), 2. chemicals (detergents, acids, caustics, sealants, finishes, stains, paints, herbicides and pesticides), 3.

Air flow (suction, blowing, compressed, cold, or warm air). The caddy 50 can be made in many styles like portable, upright, canister, back pack, truck mounted or integrated for cars and homes. Each model will have the same interchangeable pump concept 54.

The transfer unit 52 is made in this manner for a few of reasons: 1. Commercial customers can change the pumps 54 at the job site; 2. The transfer unit 52 can be upgraded or customized to suit individual customer needs; 3. It covers all the basic water or chemical needs for virtually any type of janitorial cleaning without changing the entire system; 4. There will be a great arsenal of products for upgrading.

In a way, the transfer unit 52 is designed like a personal computer. The pumps 54 and motors (not shown) can be considered "plug and play" devices. Just as you can change the floppy, CD, or DVD in a computer without changing the whole tower, you can change the pumps and motor just by plugging it in without replacing the whole transfer unit 52.

Fluids and solids travel through the hoses 20, 20*a*, 24 to and from the transfer unit 52. The hoses 20, 20*a*, 24 are flexible and resistant to chemicals and heat. A quick connect coupling with shut off valves will be on each end for fast connection and removal.

A multi-function operating switch 26 of the system is located on the handle 14. The handle 14 has buttons and switches for controlling vacuuming actuations, chemical transfer and water transfer. The control handle is a tubular shaped device and can take other shapes as well. One end of the device receives power from the transfer unit 52. The other end has a threaded coupling for connecting pressure cleaning wands, spay nozzles or the wand and head assembly. This feature allows the system to be used as a pressure washer, chemical sprayer, or cleaning machine.

The second main part of the system is the wand 12 and head assembly 16. This part of the system is a powered cleaning tool used by the operator to clean various surfaces. It primarily uses a high speed linear actuations (thousands to tens of thousands strokes per minute at up to ½ inch strokes) to move cleaning pad in a back and forth motion that is parallel to the surface for scrubbing, sanding, and polishing dirty surfaces. The cleaning wand 12 also uses a secondary actuation motion. Electromagnets are mounted on the cleaning pad unit 34 causing the accessory 38 to pulsate perpendicular to a surface at speeds up to 40,000 strokes per minute. The agitation coupled with interchangeable cleaning pads of different textures and materials can clean virtually any indoor or outdoor surface around homes, buildings, and vehicles. Indoor cleaning wands 12 have water spray nozzles for rinsing debris. Cleaning head or removable accessory 38 sizes will range from toothbrush size to extra wide floor cleaning models.

Every home, building and vehicle has different types of surfaces inside and out. Flooring alone can be carpet, linoleum, tile, hardwood, granite, laminate, marble, brick, etc. Each surface requires a different cleaning pad material 38 for optimum cleaning capabilities. The cleaning pads or removable accessory 38 will be made to match each type of surface. Cleaning pads or removable accessory 38 will be hard, or soft bristles, sponge, microfibers, soft cloth, aggressive or fine sanding material, etc.

The fresh water and chemical storage containers (also removable) 18, 18*a* are located in transfer unit caddy 50. The debris container has two chambers 18, 18*a*. Once section is for dry debris, and the other is for wet debris. The suction air flow can be redirected from one chamber to the other by simply moving a lever, allowing wet or dry debris fall into its proper chamber. An operator can switch from dry to wet vacuum mode without having to manually remove the dust filter.

The invention is set up where it can produce both a linear motion and oscillating motion. However, it is also designed to produce either a linear or oscillating motion if the user desires it for such purposes. Through the user interface, the user can activate the invention to produce one of these motions or both the linear and oscillating motion.

It is to be understood that the present invention is not limited to the embodiments described above, but encompasses any and all embodiments within the scope of the following claims.

I claim:

1. An indoor/outdoor cleaning system, comprising:

a housing unit, said housing unit having an interior volume;

plural hoses, each hose of said plural hoses having a distal end and a proximate end, said distal end opening into said interior volume;

a cleaning wand, said plural hoses attached to said cleaning wand;

a cleaning head, said cleaning head attached to said cleaning wand;

a cleaning pad unit, said cleaning pad unit disposed adjacent said cleaning head; said cleaning pad unit having a linear member, an oscillating member, a frame, said frame has a plurality of electromagnets attached on said frame, said oscillating member has a plurality of metal plates attached to said oscillating member, said plurality of electromagnets are facing said metal plates when said electromagnets are activated, said cleaning paid unit has an oscillatory motion, said linear member has a pivot point in the center of said linear member, said coupler is connected below said pivot point and said linear member, a plurality of elastic members are sandwiched between said oscillating member and said linear member, said elastic member is located at one end of said oscillating member and said linear member, said other elastic member is located at said other end of said linear member and said elastic member; and a motor attached to said cleaning pad unit.

2. The indoor/outdoor cleaning system according to claim 1, wherein said cleaning head has a base and wherein the proximate end of each hose opens adjacent said base.

3. An indoor/outdoor cleaning system, comprising:

a housing unit, said housing unit having an interior volume;

plural hoses, each hose of said plural hoses having a distal end and a proximate end, said distal end opening into said interior volume;

a cleaning wand, said plural hoses attached to said cleaning wand;

a cleaning pad unit, said cleaning pad unit disposed adjacent said cleaning head, said cleaning pad unit having a linear member, an oscillating member, a frame, said frame has a plurality of electromagnets attached on said frame, said oscillating member has a plurality of metal plates attached to said oscillating member, said plurality of electromagnets are facing said metal plates, when said electromagnets are activated, said cleaning paid unit has an oscillatory motion, said linear member has a pivot point in the center of said linear member, said coupler is connected below said pivot point and said linear member, a plurality of elastic members are sandwiched between said oscillating member and said linear member, said elastic member is located at one end of said oscillating member and said linear member, said other elastic member is located at said other end of said linear member and said elastic member;

a motor has a shaft, said shaft is connected to a guide, said guide is attached above said linear member on one end of said linear member on the other end of said, a second guide is attached above said linear member on the other end of said linear member when said motor is activated, said cleaning pad unit has a back-and-forth motion.

4. The indoor/outdoor cleaning system according to claim 3, wherein said cleaning head has a base and wherein the proximate end of each hose opens adjacent said base.

5. An indoor/outdoor cleaning system, comprising:

a housing unit, said housing unit having an interior volume;

a cleaning wand, said plural hoses attached to said cleaning wand;

a cleaning head, said cleaning head attached to said cleaning wand;

a cleaning pad unit, said cleaning pad unit disposed adjacent said cleaning head, said cleaning pad unit having a linear member, an oscillating member, a frame, said frame has a plurality of electromagnets attached on said frame, said oscillating member has a plurality of metal plates attached to said oscillating member, said plurality of electromagnets are facing said metal plates, when said electromagnets are activated, said cleaning paid unit has an oscillatory motion, said linear member has a pivot point in the center of said linear member, said coupler is connected below said pivot point and said linear member, a plurality of elastic members are sandwiched between said oscillating member and said linear member, said elastic member is located at one end of said oscillating member and said linear member, said other elastic member is located at said other end of said linear member and said elastic member; and a motor has a shaft, said shaft is connected to a guide, said guide is attached above said linear member on one end of said linear member on the other end of said, a second guide is attached above said linear member on the other end of said linear member when said motor is activated, said cleaning pad unit has a back-and-forth motion.

6. The indoor/outdoor cleaning system according to claim 5, wherein said cleaning head has a base and wherein the proximate end of each hose opens adjacent said base.

* * * * *